US011826602B1

(12) United States Patent
Lu

(10) Patent No.: US 11,826,602 B1
(45) Date of Patent: Nov. 28, 2023

(54) WIND RESISTANCE TYPE SPINNING BIKE

(71) Applicant: NINGBO JADA HEALTH TECH. CO., LTD., Zhejiang (CN)

(72) Inventor: Weidong Lu, Zhejiang (CN)

(73) Assignee: NINGBO JADA HEALTH TECH. CO., LTD., Ningbo (CN)

( * ) Notice: Subject to any disclaimer, the term of this patent is extended or adjusted under 35 U.S.C. 154(b) by 0 days.

(21) Appl. No.: 17/707,685

(22) Filed: Mar. 29, 2022

(30) Foreign Application Priority Data

| | | |
|---|---|---|
| Feb. 14, 2022 | (CN) | 202220291937.9 |
| Feb. 14, 2022 | (CN) | 202220291959.5 |
| Feb. 14, 2022 | (CN) | 202220291960.8 |
| Feb. 14, 2022 | (CN) | 202220291963.1 |

(51) Int. Cl.
*A63B 21/22* (2006.01)
*A63B 22/06* (2006.01)

(52) U.S. Cl.
CPC ..... *A63B 21/225* (2013.01); *A63B 22/0605* (2013.01)

(58) Field of Classification Search
USPC ..... 482/59
See application file for complete search history.

(56) References Cited

U.S. PATENT DOCUMENTS

| | | | | |
|---|---|---|---|---|
| 4,772,013 | A * | 9/1988 | Tarlow, Jr. | A63B 22/0076 482/901 |
| 4,875,674 | A * | 10/1989 | Dreissigacker | A63B 22/0076 482/901 |
| 5,290,212 | A * | 3/1994 | Metcalf | A63B 21/4049 482/111 |
| 5,443,434 | A * | 8/1995 | Buchanan | A63B 22/001 482/111 |
| 6,446,005 | B1 * | 9/2002 | Bingeman | G05D 1/0278 701/472 |
| 9,889,336 | B1 * | 2/2018 | Chen | A63B 22/0605 |
| 10,155,132 | B2 * | 12/2018 | Jones | A63B 21/154 |
| 2014/0243171 | A1 * | 8/2014 | Huang | A63B 22/203 482/118 |
| 2018/0064982 | A1 * | 3/2018 | Chen | A63B 21/15 |
| 2019/0126099 | A1 * | 5/2019 | Hoang | A63F 13/335 |

* cited by examiner

*Primary Examiner* — Shila Jalalzadeh Abyaneh

(57) ABSTRACT

The present disclosure provides a wind resistance type spinning bike, including a frame assembly. A fan assembly is installed at a front end of the frame assembly by a fan fixing assembly. A drive assembly is installed at a rear end of the frame assembly. The drive assembly is connected with the fan assembly by a multi-groove belt. The drive assembly may drive the fan assembly to rotate. Swing armrest assemblies are installed on two sides of the front end of the frame assembly, and are connected with the drive assembly by connecting rod assemblies. A seat cushion assembly is installed on an upper portion of the rear end of the frame assembly. By arranging the fan assembly, during operation by a user, the air flows to promote indoor air circulation, thereby enabling people to effectively persist in exercising and preventing heat stroke.

8 Claims, 19 Drawing Sheets

WIND RESISTANCE TYPE SPINNING BIKE

CROSS-REFERENCE TO RELATED APPLICATIONS

This application claims priorities from Chinese patent application 2022202919631 filed Feb. 14, 2022, Chinese patent application 2022202919608 filed Feb. 14, 2022, Chinese patent application 2022202919595 filed Feb. 14, 2022, and from Chinese patent application 2022202919379 filed Feb. 14, 2022, the content of which are incorporated herein in the entirety by reference.

FIELD OF TECHNOLOGY

The present disclosure relates to the technical field of fitness equipment, in particular to a wind resistance type spinning bike.

BACKGROUND

With the continuous improvement of the living standards of residents, people pay more and more attention to health. Therefore, there are lots of fitness equipment, and spinning bikes are one of them. The spinning bikes are easy to learn and suitable for people of most age groups as a kind of aerobic exercise that may exercise the whole body. After exercise, the spinning bikes may consume a lot of energy and make people sweat a lot. Meanwhile, the spinning bikes further enhance the strength of your legs, shape the lower limbs, and improve the body's oxygen uptake.

However, most of existing spinning bikes work by inertia of flywheels and magnetic resistance. In a closed gym, people may be very hot and uncomfortable, so that people are unable to persist or even have heat stroke to cause a life risk. Therefore, there is a lack of spinning bikes that may not only exercise the body, but also promote indoor air circulation in the market, and the current spinning bikes may only exercise the abdomen and lower limbs and may not exercise the hands.

SUMMARY

An objective of the present disclosure is to provide a wind resistance type spinning bike, so as to solve the technical problems that most of existing spinning bikes work by inertia of flywheels and magnetic resistance; in a closed gym, people may be very hot and uncomfortable, so that people are unable to persist or even have heat stroke to cause a life risk; and therefore, there is a lack of spinning bikes that may not only exercise the body, but also promote indoor air circulation in the market, and the current spinning bikes may only exercise the abdomen and lower limbs and may not exercise the hands in the background.

To achieve the above objective, the present disclosure provides the following technical solution: A wind resistance type spinning bike, including a frame assembly, wherein a fan assembly is installed at a front end of the frame assembly by a fan fixing assembly; a drive assembly is installed at a rear end of the frame assembly; the drive assembly is connected with the fan assembly by a multi-groove belt; the drive assembly may drive the fan assembly to rotate; swing armrest assemblies are installed on two sides of the front end of the frame assembly, and are connected with the drive assembly by connecting rod assemblies; a seat cushion assembly is installed on an upper portion of the rear end of the frame assembly;

the fan assembly includes a fan blade fixing pipe, fan blade fixing sheets and a plurality of fan blades; two fan blade fixing sheets are welded and fixed to the fan blade fixing pipe; the fan blades are fixed and welded to the two fan blade fixing sheets around the circumference; the fan blade fixing pipe is provided with a through hole in the center; two ends of the through hole are provided with fixing pipe bearings; one end of the fan blade fixing pipe is provided with a groove configured to install the multi-groove belt;

the frame assembly includes a main frame bent pipe; the main frame bent pipe is U-shaped; two rim fixing plates are symmetrically welded to the main frame bent pipe; the rim fixing plates are provided with U-shaped grooves; the fan assembly is installed on the rim fixing plates by the fan fixing assembly; the fan fixing assembly includes a rim shaft core arranged in the central through hole of the fan blade fixing pipe, rim limiting sleeves symmetrically installed on two sides of the rim shaft core, nuts and flange nuts; two ends of the rim shaft core are provided with external threads; the nuts, the flange nuts and the rim shaft core are in threaded connection; the two ends of the rim shaft core are installed in the U-shaped grooves of the rim fixing plates; and the flange nuts are installed on the rim shaft core on the outer sides of the rim fixing plates.

Preferably, chain puller assemblies are symmetrically installed on two sides of the rim shaft core; each of the chain puller assemblies includes a chain puller, a chain puller pressing sheet and a locking nut; one end of the chain puller is provided with a gasket, and the other end of the chain puller is provided with a screw; the gasket is sleeved on the rim shaft core and is arranged between the flange nut and the rim fixing plate; the chain puller pressing sheet and the locking nut are installed at an end portion of the screw; the chain puller pressing sheet abuts against a top surface of the rim fixing plate; and when the locking nut is tightened, the chain puller can pull the fan assembly and the fan fixing assembly to move away from the drive assembly, so as to adjust the tightness of the multi-groove belt.

Preferably, a sensor fixing plate is welded to the rim limiting sleeve on one side of the rim shaft core; a speed sensor is installed on the sensor fixing plate; and magnets are fixedly installed on the fan blade fixing sheets, and are located on the same circumferential surface as the speed sensor.

Preferably, the frame assembly further includes a beveled connecting pipe welded to a lower portion of the main frame bent pipe; the beveled connecting pipe is U-shaped; a bent pipe connecting pipe is welded to a rear end of the beveled connecting pipe; a rear support pipe is welded to a rear end of the bent pipe connecting pipe; a rotating shaft fixing pipe is welded to an upper end of the middle of the bent pipe connecting pipe; a seat cushion support pipe is welded to an upper end of the rotating shaft fixing pipe; the middle of the seat cushion support pipe and an upper end of the rear support pipe are welded and fixed; a meter panel fixing pipe is welded to the top of the main frame bent pipe; a main frame pipe is welded between the meter panel fixing pipe and the bent pipe connecting pipe; a reinforcing pipe is welded between the main frame pipe and the seat cushion support pipe; a rotating shaft fixing seat is installed on the rotating shaft fixing pipe; a main frame front fixing plate is welded to the bottom of the main frame bent pipe; and a main frame rear fixing plate is welded to a lower end of the rear support pipe.

Preferably, the drive assembly includes a central shaft, central shaft bearings, a crank limiting sleeve, a left connecting crank, a belt pulley, a right connecting crank and pedal assemblies; the central shaft is installed in the rotating shaft fixing seat in a penetration manner; the central shaft bearings are symmetrically installed between the central shaft and the rotating shaft fixing seat; the crank limiting sleeve is installed on a left side of the central shaft; the left connecting crank is installed on a left side of the crank limiting sleeve; the belt pulley is installed on a right side of the central shaft; the right connecting crank is installed on a right side of the belt pulley by bolts; the belt pulley is connected with the fan blade fixing pipe by the multi-groove belt; each of two ends of the central shaft is provided with a central shaft pin; each of the left connecting crank and the right connecting crank is provided with a central shaft pin hole; the central shaft pins are respectively inserted into the central shaft pin holes of the left connecting crank and the right connecting crank; the left connecting crank and the right connecting crank are further provided with crank pin holes; each of the left connecting crank and the right connecting crank is provided with the pedal assembly by the corresponding crank pin hole; the pedal assembly includes a crank fixing shaft, a crank fixing sleeve, a pedal connecting plate and a pedal; the crank fixing shaft is inserted into the corresponding crank pin hole; the crank fixing sleeve is sleeved on the crank fixing shaft; the pedal connecting plate is fixedly installed on an outer side of the crank fixing shaft; and the pedal is installed on an outer side of the pedal connecting plate.

Preferably, open grooves are formed on two sides of each of the central shaft pin holes and the crank pin holes in the left connecting crank and the right connecting crank; and a plane perpendicular to the open grooves is further provided with threaded holes configured to install locking bolts.

Preferably, swing armrest fixing shafts are welded and fixed to the middles of two sides of the main frame bent pipe; the swing armrest assemblies are movably installed on the swing armrest fixing shafts; each of the swing armrest assemblies includes an armrest pipe, a swing armrest fixing plate, a swing armrest rotating shaft fixing seat, swing armrest bearings and an L-shaped handle; the L-shaped handle is installed at an upper end of the armrest pipe; the swing armrest fixing plate is welded to a lower end of the armrest pipe; the swing armrest rotating shaft fixing seat is fixedly installed at an upper end of the swing armrest fixing plate; the swing armrest bearings are symmetrically installed in the swing armrest rotating shaft fixing seat, and are sleeved on the corresponding swing armrest fixing shaft; the swing armrest assembly may rotate around the corresponding swing armrest fixing shaft; and a pedal pipe is further installed at an end portion of the corresponding swing armrest fixing shaft.

Preferably, each of the connecting rod assemblies includes a connecting rod, connecting rod fixing pressure plates, a front bearing with a snap ring and a rear bearing with a snap ring; the connecting rod fixing pressure plates are symmetrically installed at the end, close to the corresponding swing armrest assembly, of the connecting rod; the front bearing with the snap ring is installed between the two connecting rod fixing pressure plates; the connecting rod fixing pressure plates are rotatably connected with the corresponding swing armrest fixing plate by the front bearing with the snap ring; and a rear end of the connecting rod is rotatably connected with the corresponding crank fixing shaft by the rear bearing with the snap ring.

Preferably, the seat cushion assembly includes a lifting adjustment pipe inserted into the seat cushion support pipe, a lower slider welded to the top of the lifting adjustment tube, an upper slider movably installed at an upper end of the lower slider and a seat cushion installed on the upper slider by a seat cushion fixing shaft; a plurality of insertion holes are evenly distributed in the lifting adjustment pipe; a quick release wrench is further installed at a rear end of the seat cushion support pipe; a bolt of the quick release wrench may be inserted into the plurality of insertion holes, so as to adjust the height of the seat cushion; the upper slider is further provided with an adjustment assembly; the lower slider is internally provided with a square groove; the adjustment assembly includes a seat cushion limiting sleeve pipe, a knob and a limiting bolt; the limiting bolt penetrates through the seat cushion limiting sleeve pipe upwards and then is in threaded connection with the knob; a lower end of the limiting bolt is disposed in the square groove and has a shape that matches with the square groove; and the knob may drive the limiting bolt to move up or down.

Preferably, a front foot pipe is installed at a lower end of the main frame front fixing plate; rollers are installed at a front end of the front foot pipe; a rear foot pipe is installed at a lower end of the main frame rear fixing plate; rubber foot pads are installed at a lower end of each of the front foot pipe and the rear foot pipe; an electronic meter connecting pipe is installed at an upper end of the meter panel fixing pipe; an electronic meter is installed at an upper end of the electronic meter connecting pipe, and is electrically connected with the speed sensor; a front fan cover and a rear fan cover are further installed on an outer side of the fan assembly; a wind shield is installed at a front end of the main frame pipe; and a water bottle holder is installed at a rear end of the main frame pipe.

Compared with the prior art, the present disclosure has the following beneficial effects:

According to the wind resistance type spinning bike, by arranging the fan assembly, during operation by a user, the air flows to promote indoor air circulation, thereby enabling people to effectively persist in exercising and preventing heat stroke; and meanwhile, armrests are swung in a dislocated manner by stepping on pedals, and then people may move their hands by dislocation movement after holding the L-shaped handles, so as to exercise the hands. Meanwhile, the user also may put two feet on the pedal pipes, and just use two hands to pull the L-shaped handles back and forth in a dislocated manner, so as to drive the drive assembly only by force of the two hands, and then the drive assembly drives the fan assembly to rotate, so as to better exercise the arms.

Figure 1:
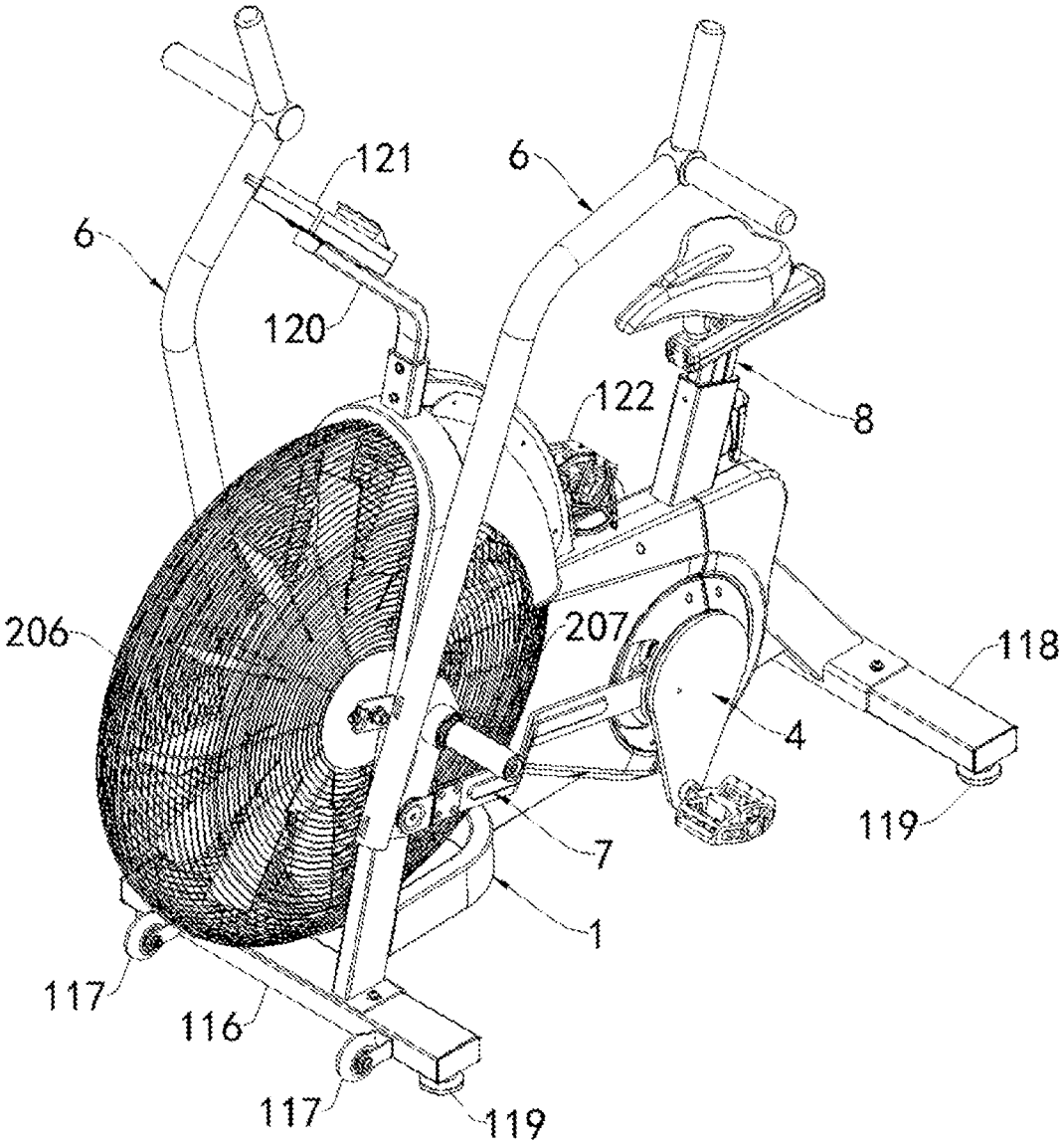
FIG. 1 is an overall stereostructure schematic diagram of the present disclosure.

In the figures: 1, frame assembly; 101, main frame bent pipe; 102, rim fixing plate; 103, U-shaped groove; 104, beveled connecting pipe; 105, bent pipe connecting pipe; 106, rear support pipe; 107, rotating shaft fixing pipe; 108, seat cushion support pipe; 109, meter panel fixing pipe; 110, main frame pipe; 111, reinforcing pipe; 112, rotating shaft fixing seat; 113, swing armrest fixing shaft; 114, main frame front fixing plate; 115, main frame rear fixing plate; 116, front foot pipe; 117, roller; 118, rear foot pipe; 119, rubber foot pad; 120, electronic meter connection pipe; 121, electronic meter; 122, water bottle holder; 2, fan assembly; 201, fan blade fixing pipe; 202, fan blade fixing sheet; 203, fan blade; 204, fixing pipe bearing; 205, groove; 206, front fan cover; 207, rear fan cover; 208, wind shield; 3, fan fixing assembly; 301, rim shaft core; 302, rim limiting sleeve; 303, nut; 304, flange nut; 305, sensor fixing plate; 306, speed sensor; 307, magnet; 4, drive assembly; 401, central shaft; 4011, central shaft pin; 402, central shaft bearing; 403, crank limiting sleeve; 404, left connecting crank; 405, belt pulley; 406, right connecting crank; 407, central shaft pin hole; 408, crank pin hole; 409, open groove; 44, pedal assembly; 441, crank fixing shaft; 442, crank fixing sleeve; 443, pedal connecting plate; 444, pedal; 5, multi-groove belt; 6, swing armrest assembly; 601, armrest pipe; 602, swing armrest fixing plate; 603, swing armrest rotating shaft fixing seat; 604, swing armrest bearing; 605, L-shaped handle; 606, pedal pipe; 7, connecting rod assembly; 701, connecting rod; 702, connecting rod fixing pressure plate; 703, front bearing with snap ring; 704, rear bearing with snap ring; 8, seat cushion assembly; 801, lifting adjustment pipe; 8011, insertion hole; 802, lower slider; 8021, square groove; 803, upper slider; 804, seat cushion fixing shaft; 805, seat cushion; 806, quick release wrench; 807, seat cushion limiting sleeve pipe; 808, knob; 809, limiting bolt; 9, chain puller assembly; 901, chain puller; 902, chain puller pressing sheet; 903, locking nut; 904, gasket; and 905, screw.

DETAILED DESCRIPTION OF THE EMBODIMENTS

The technical solution in the embodiments of the present disclosure is clearly and completely described below with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the protection scope of the present disclosure.

As shown in FIGS. 1-19, the present disclosure provides a technical solution: a wind resistance type spinning bike, including a frame assembly 1, wherein a fan assembly 2 is installed at a front end of the frame assembly 1 by a fan fixing assembly 3; a drive assembly 4 is installed at a rear end of the frame assembly 1; the drive assembly 4 is connected with the fan assembly 2 by a multi-groove belt 5; the drive assembly 4 may drive the fan assembly 2 to rotate; swing armrest assemblies 6 are installed on two sides of the front end of the frame assembly 1, and are connected with the drive assembly 4 by connecting rod assemblies 7; and a seat cushion assembly 8 is installed on an upper portion of the rear end of the frame assembly 1. By arranging the fan assembly, when a user steps on the drive assembly 4, the fan assembly is driven to rotate to generate resistance, thereby making the user exercise the leg muscles; and meanwhile, the fan assembly rotates to generate air flow to promote indoor air circulation, thereby enabling people to effectively persist in exercising and preventing heat stroke.

Figure 8:
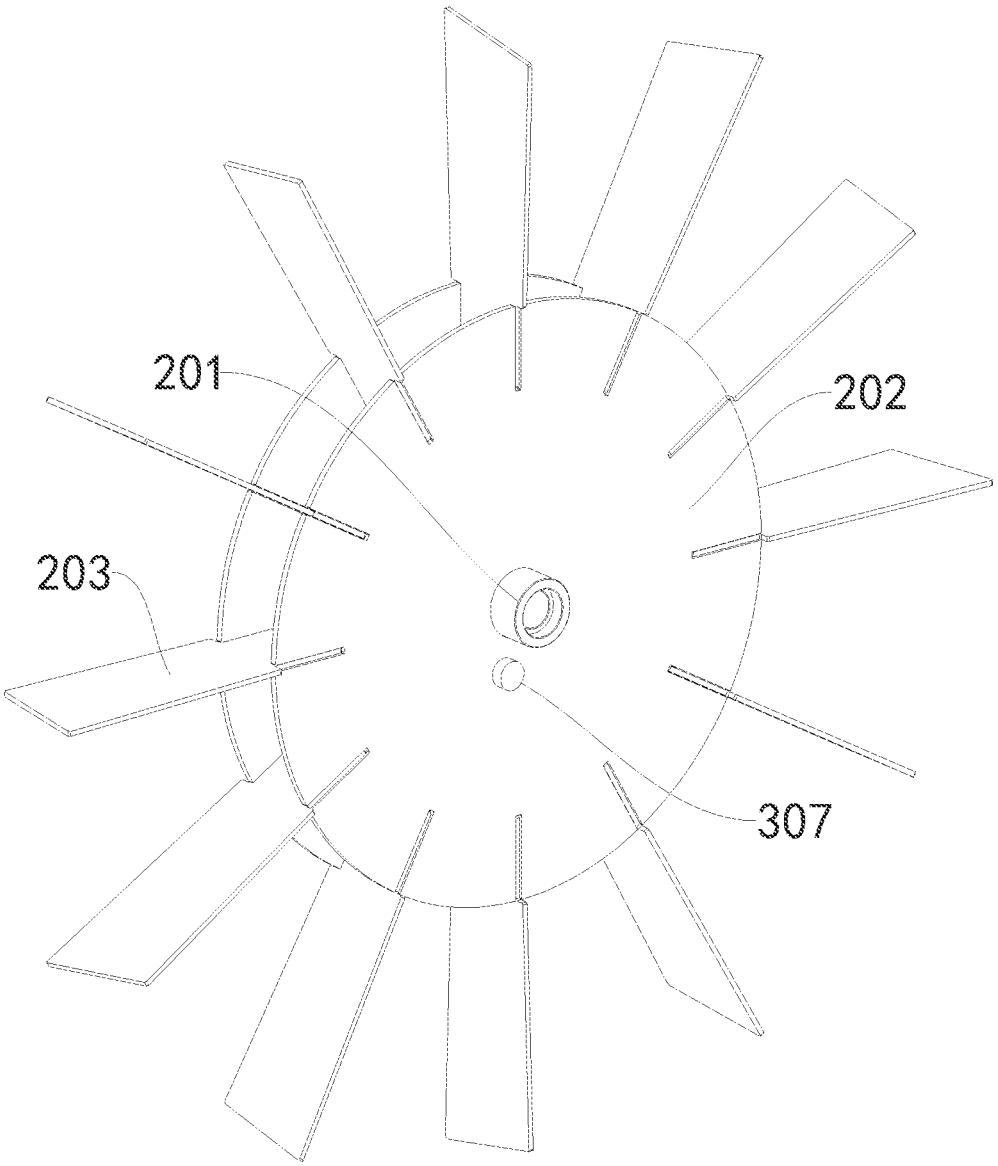
FIG. 8 is a structure schematic diagram of a fan assembly according to the present disclosure.
Figure 9:
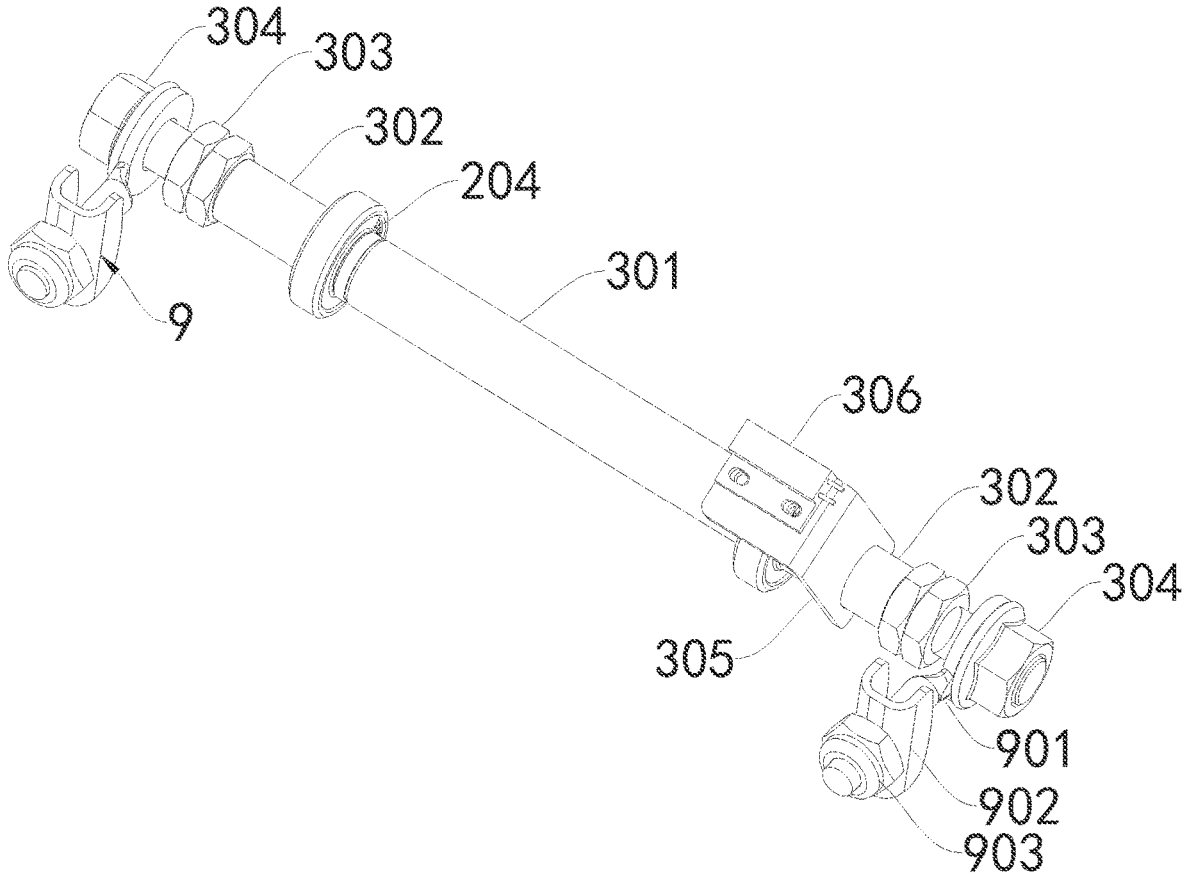
FIG. 9 is a structure schematic diagram of a fan fixing assembly according to the present disclosure.
Figure 10:
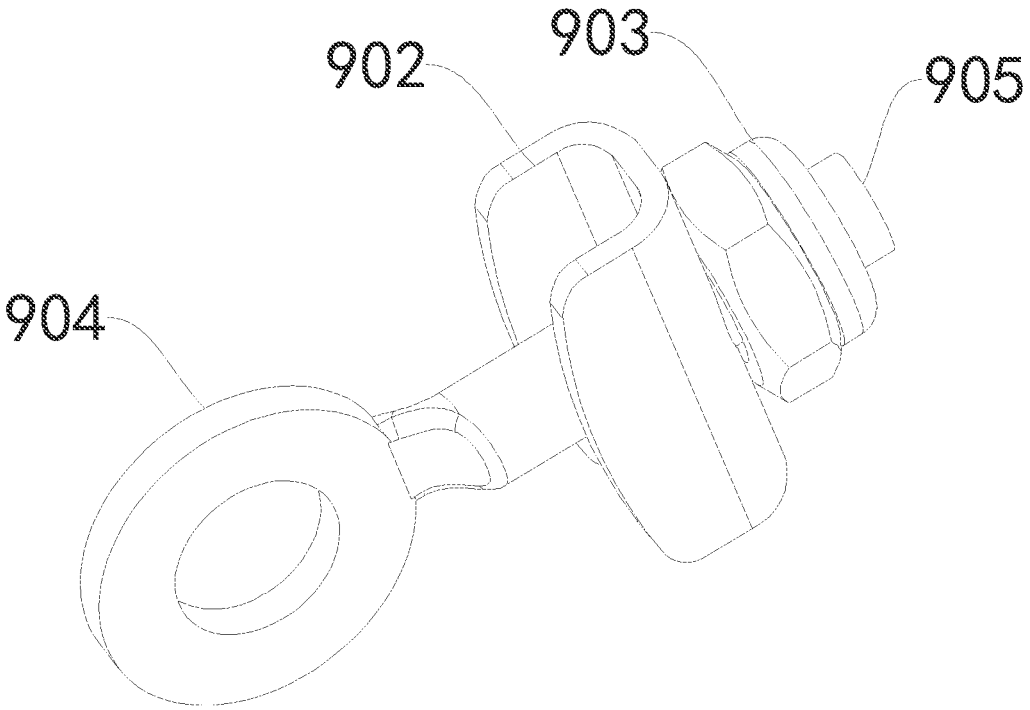
FIG. 10 is a structure schematic diagram of a chain puller assembly according to the present disclosure.

As shown in FIG. 8, the fan assembly 2 includes a fan blade fixing pipe 201, fan blade fixing sheets 202 and a plurality of fan blades 203; two fan blade fixing sheets 202 are welded and fixed to the fan blade fixing pipe 201; the fan blades 203 are fixed and welded to the two fan blade fixing sheets 202 around the circumference; the fan blade fixing pipe 201 is provided with a through hole in the center; two ends of the through hole are provided with fixing pipe bearings 204; and one end of the fan blade fixing pipe 201 is provided with a groove 205 configured to install the multi-groove belt 5. The plurality of fan blades 203 are arranged to provide greater wind resistance, provide a user with enough pedaling resistance, and improve a fitness effect.

As shown in FIGS. 8-11, the frame assembly 1 includes a main frame bent pipe 101; the main frame bent pipe 101 is U-shaped; two rim fixing plates 102 are symmetrically welded to the main frame bent pipe 101; the rim fixing plates 102 are provided with U-shaped grooves 103; the fan assembly 2 is installed on the rim fixing plates 102 by the fan fixing assembly 3; the fan fixing assembly 3 includes a rim shaft core 301 arranged in the central through hole of the fan blade fixing pipe 201, rim limiting sleeves 302 symmetrically installed on two sides of the rim shaft core 301, nuts 303 and flange nuts 304; two ends of the rim shaft core 301 are provided with external threads; the nuts 303, the flange nuts 304 and the rim shaft core 301 are in threaded connection; the two ends of the rim shaft core 301 are installed in the U-shaped grooves 103 of the rim fixing plates 102; and the flange nuts 304 are installed on the rim shaft core 301 on the outer sides of the rim fixing plates 102. The rim shaft core 301 penetrates through the fixing pipe bearings 204 installed at the two ends of the fan blade fixing pipe 201, extends towards two sides to penetrate through the U-shaped grooves 103 and extends by a part outwards to install the flange nuts 304, and after the nuts 303 are tightened, the rim limiting sleeves 302 are squeezed inwards to prevent the rim shaft core 301 from loosening; and the two nuts 303 are installed on each side to better prevent loosening.

As shown in FIGS. 1-10, chain puller assemblies 9 are symmetrically installed on two sides of the rim shaft core 301; each of the chain puller assemblies 9 includes a chain puller 901, a chain puller pressing sheet 902 and a locking nut 903; one end of the chain puller 901 is provided with a gasket 904, and the other end of the chain puller 901 is provided with a screw 905; the gasket 904 sleeves the rim shaft core 301 and is arranged between the flange nut 304 and the rim fixing plate 102; the chain puller pressing sheet 902 and the locking nut 903 are installed at an end portion of the screw 905; the chain puller pressing sheet 902 abuts against a top surface of the rim fixing plate 102; and when the locking nut 903 is tightened, the chain puller 901 can pull the fan assembly 2 and the fan fixing assembly 3 to move away from the drive assembly 4, so as to adjust the tightness of the multi-groove belt 5. By arranging the chain puller assemblies 9, the tightness of the multi-groove belt 5 can be conveniently adjusted, and the adjustment of the tightness can further provide the user with different resistances.

Figure 2:
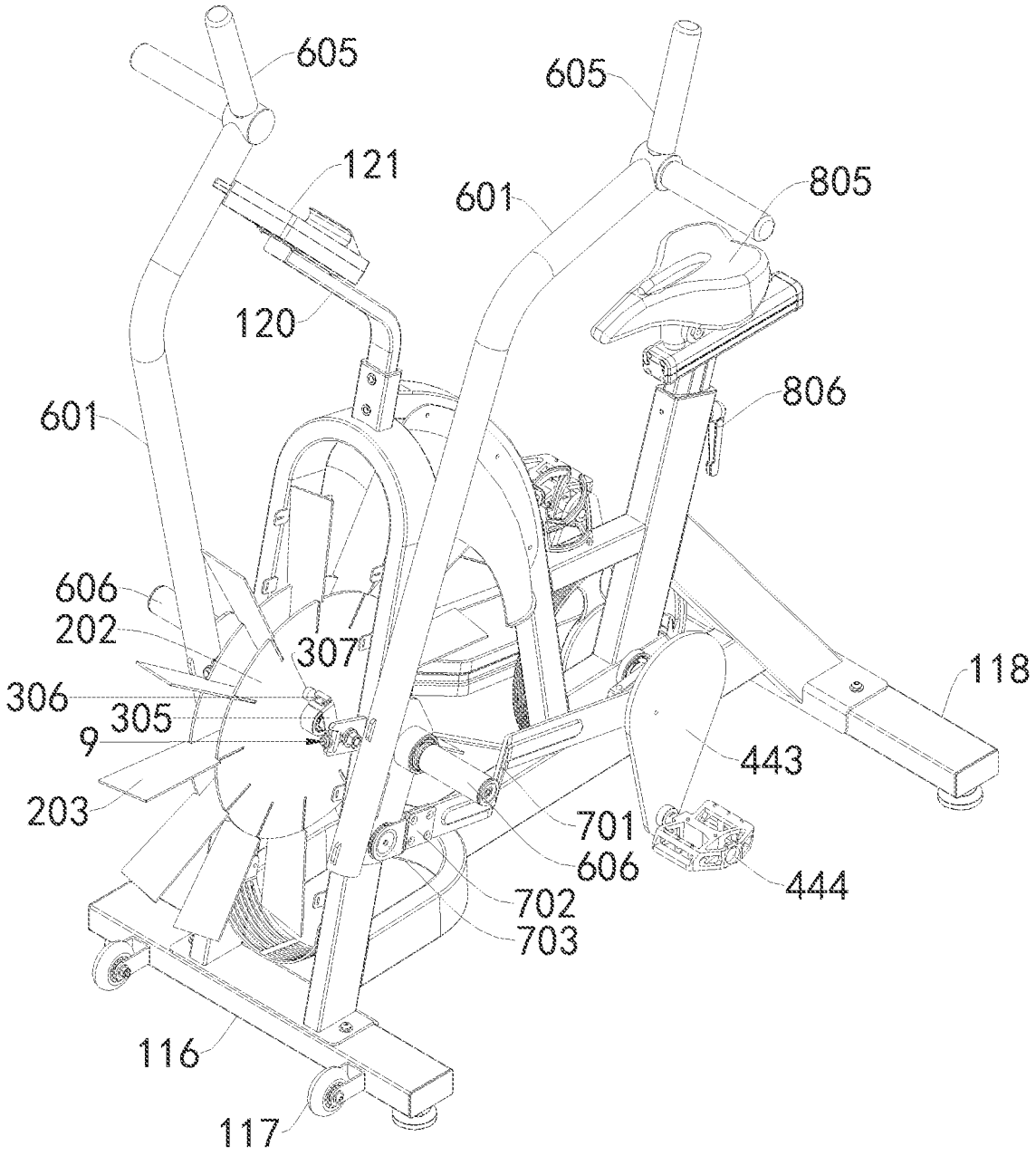
FIG. 2 is a stereostructure schematic diagram of the present disclosure.
Figure 3:
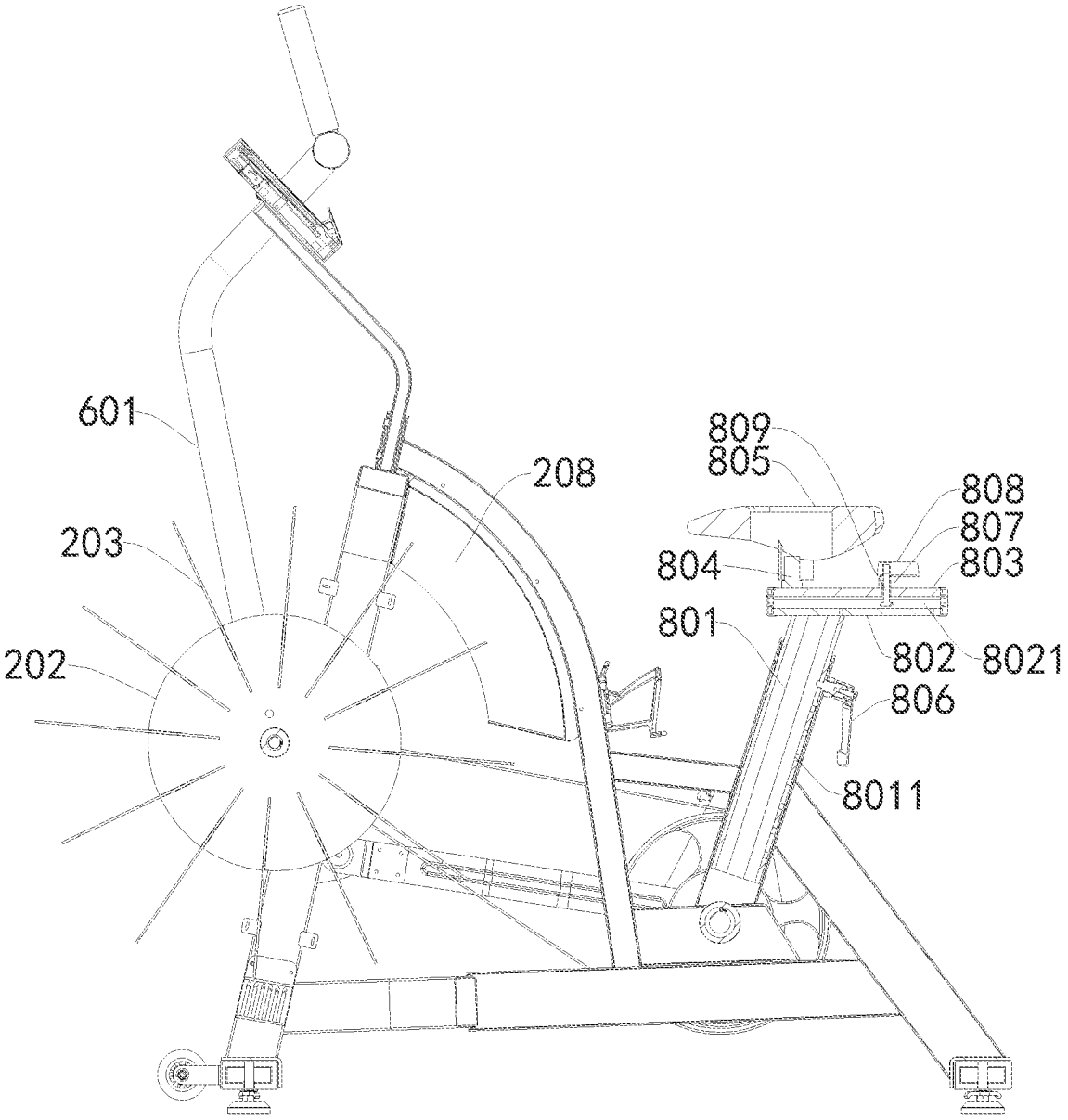
FIG. 3 is an overall cross-sectional view of the present disclosure.
Figure 4:
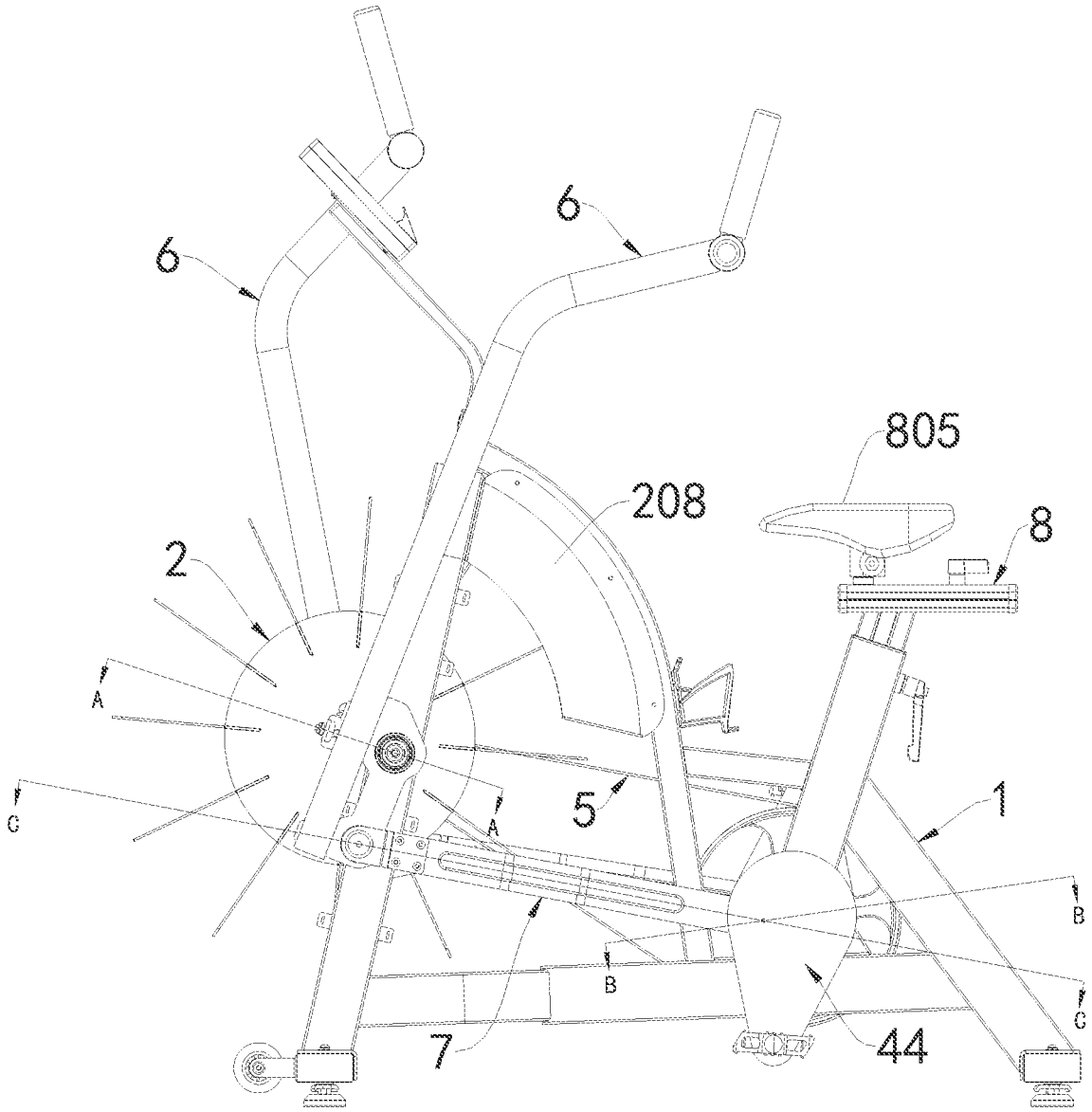
FIG. 4 is a front view of the present disclosure.
Figure 5:
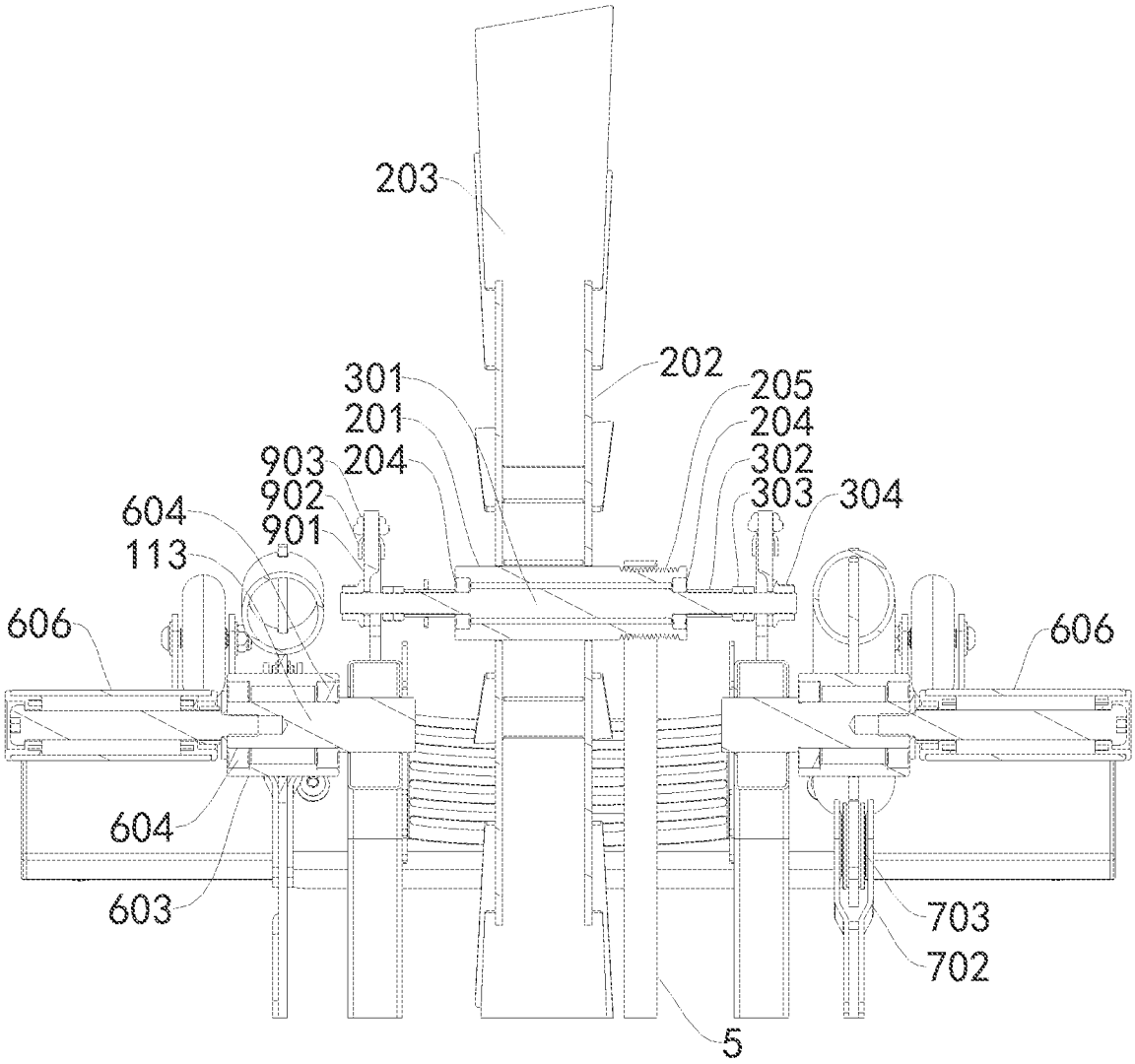
FIG. 5 is a cross-sectional view at A-A in FIG. 4 of the present disclosure.
Figure 6:
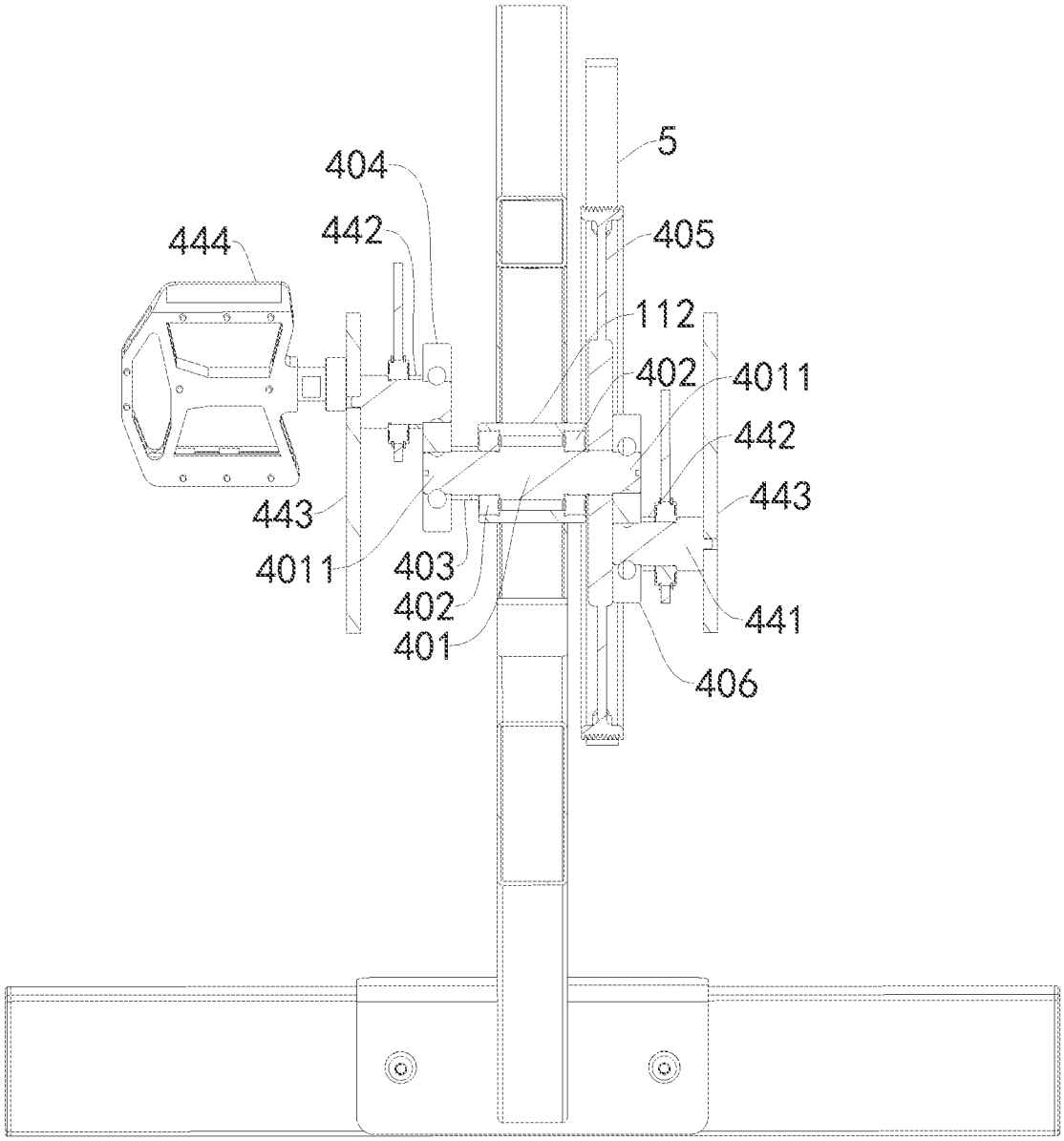
FIG. 6 is a cross-sectional view at B-B in FIG. 4 of the present disclosure.
Figure 7:
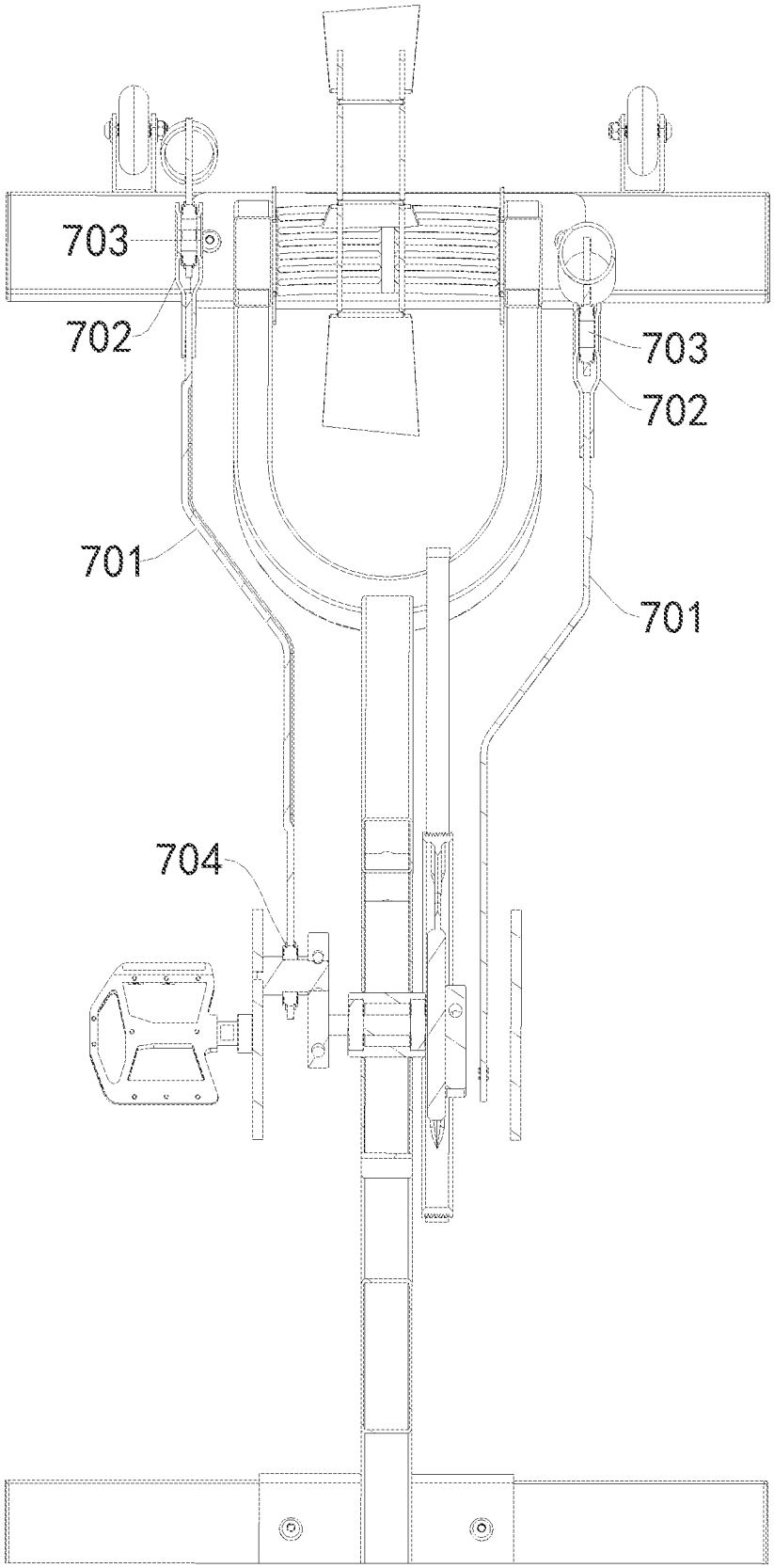
FIG. 7 is a cross-sectional view at C-C in FIG. 4 of the present disclosure.

As shown in FIG. 2, a sensor fixing plate 305 is welded to the rim limiting sleeve 302 on one side of the rim shaft core 301; a speed sensor 306 is installed on the sensor fixing plate 305; and magnets 307 are fixedly installed on the fan blade fixing sheets 202, and are located on the same circumferential surface as the speed sensor 306. The magnets 307 rotate along with the fan blade fixing sheets 202, and the speed sensor 306 senses interval time of the magnets 307 by recognition to calculate a riding speed that is displayed on an electronic meter 121.

Figure 11:
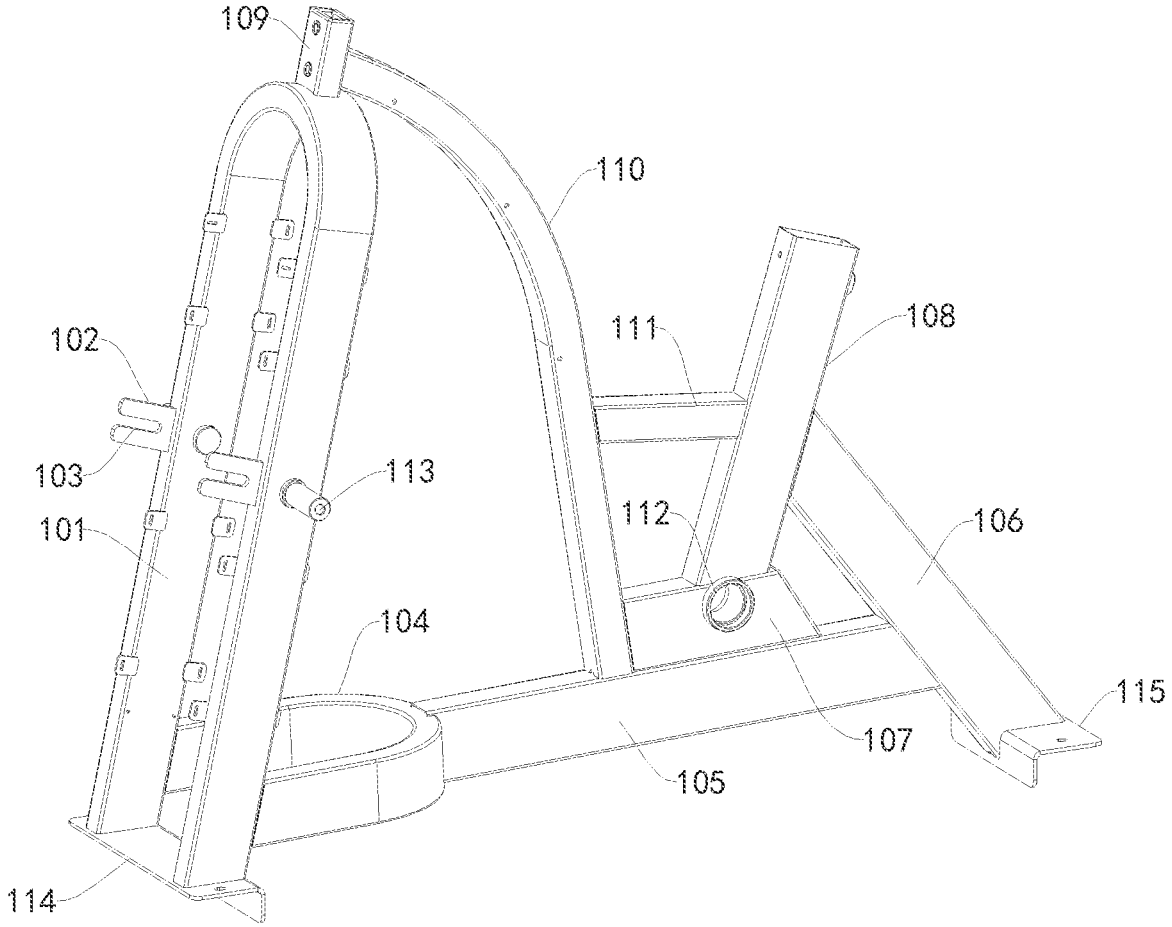
FIG. 11 is a structure schematic diagram of a frame assembly according to the present disclosure.

As shown in FIG. 11, the frame assembly 1 further includes a beveled connecting pipe 104 welded to a lower portion of the main frame bent pipe 101; the beveled connecting pipe 104 is U-shaped; a bent pipe connecting pipe 105 is welded to a rear end of the beveled connecting pipe 104; a rear support pipe 106 is welded to a rear end of the bent pipe connecting pipe 105; a rotating shaft fixing pipe 107 is welded to an upper end of the middle of the bent pipe connecting pipe 105; a seat cushion support pipe 108 is welded to an upper end of the rotating shaft fixing pipe 107; the middle of the seat cushion support pipe 108 and an upper end of the rear support pipe 106 are welded and fixed; a meter panel fixing pipe 109 is welded to the top of the main frame bent pipe 101; a main frame pipe 110 is welded between the meter panel fixing pipe 109 and the bent pipe connecting pipe 105; a reinforcing pipe 111 is welded between the main frame pipe 110 and the seat cushion support pipe 108; a rotating shaft fixing seat 112 is installed on the rotating shaft fixing pipe 107; a main frame front fixing plate 114 is welded to the bottom of the main frame bent pipe 101; and a main frame rear fixing plate 115 is welded to a lower end of the rear support pipe 106. Therefore, the whole spinning bike is provided with a stable frame, and the use safety is improved.

As shown in FIGS. 1-13, the drive assembly 4 includes a central shaft 401, central shaft bearings 402, a crank limiting sleeve 403, a left connecting crank 404, a belt pulley 405, a right connecting crank 406 and pedal assemblies 44; the central shaft 401 is installed in the rotating shaft fixing seat 112 in a penetration manner; the central shaft bearings 402 are symmetrically installed between the central shaft 401 and the rotating shaft fixing seat 112; the crank limiting sleeve 403 is installed on a left side of the central shaft 401; the left connecting crank 404 is installed on a left side of the crank limiting sleeve 403; the belt pulley 405 is installed on a right side of the central shaft 401; the right connecting crank 406 is installed on a right side of the belt pulley 405 by bolts; the belt pulley 405 is connected with the fan blade fixing pipe 201 by the multi-groove belt 5; each of two ends of the central shaft 401 is provided with a central shaft pin 4011; each of the left connecting crank 404 and the right connecting crank 406 is provided with a central shaft pin hole 407; the central shaft pins 4011 are respectively inserted into the central shaft pin holes 407 of the left connecting crank 404 and the right connecting crank 406; the left connecting crank 404 and the right connecting crank 406 are further provided with crank pin holes 408; each of the left connecting crank 404 and the right connecting crank 406 is provided with the pedal assembly 44 by the corresponding crank pin hole 408; the pedal assembly 44 includes a crank fixing shaft 441, a crank fixing sleeve 442, a pedal connecting plate 443 and a pedal 444; the crank fixing shaft 441 is inserted into the corresponding crank pin hole 408; the crank fixing sleeve 442 is sleeved on the crank fixing shaft 441 to fix a rear bearing (704) with a snap ring in the corresponding connecting rod assembly so as to prevent the rear bearing with the snap ring from shaking; the pedal connecting plate 443 is fixedly installed on an outer side of the crank fixing shaft 441; and the pedal 444 is installed on an outer side of the pedal connecting plate 443. The left connecting crank 404 and the right connecting crank 406 are installed in opposite directions to ensure that the swing armrest assemblies 6 installed on the two sides of the front end of the frame assembly 1 are always in a back-and-forth dislocation state, and the state is more in line with the back-and-forth arm swing movement of the left and right hands of the user when the user does exercise.

Figure 14:
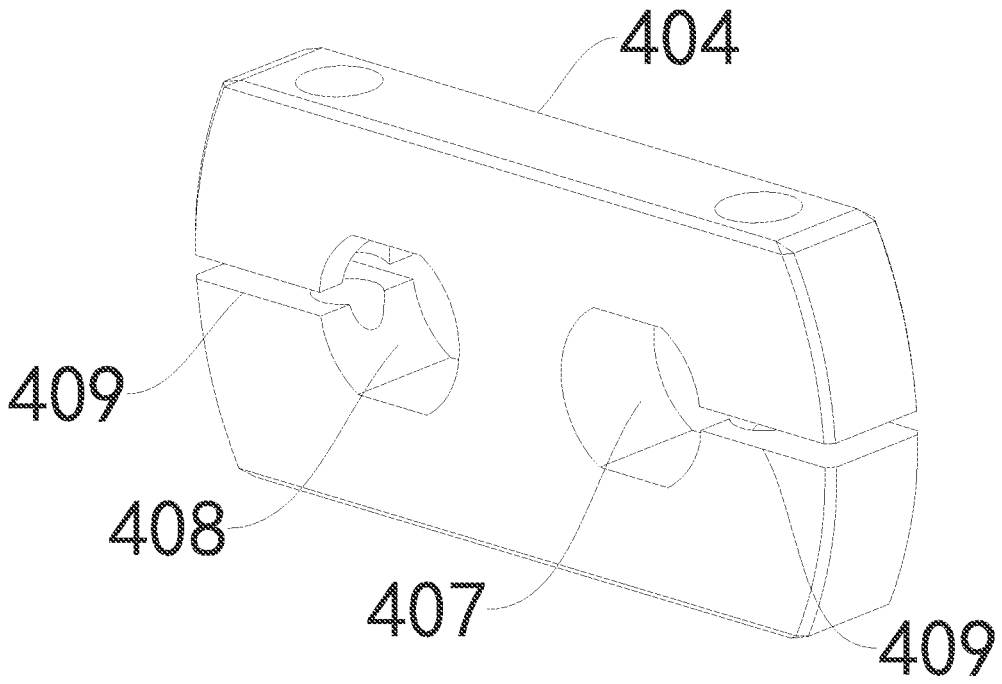
FIG. 14 is a structure schematic diagram of a left connecting crank according to the present disclosure.
Figure 15:
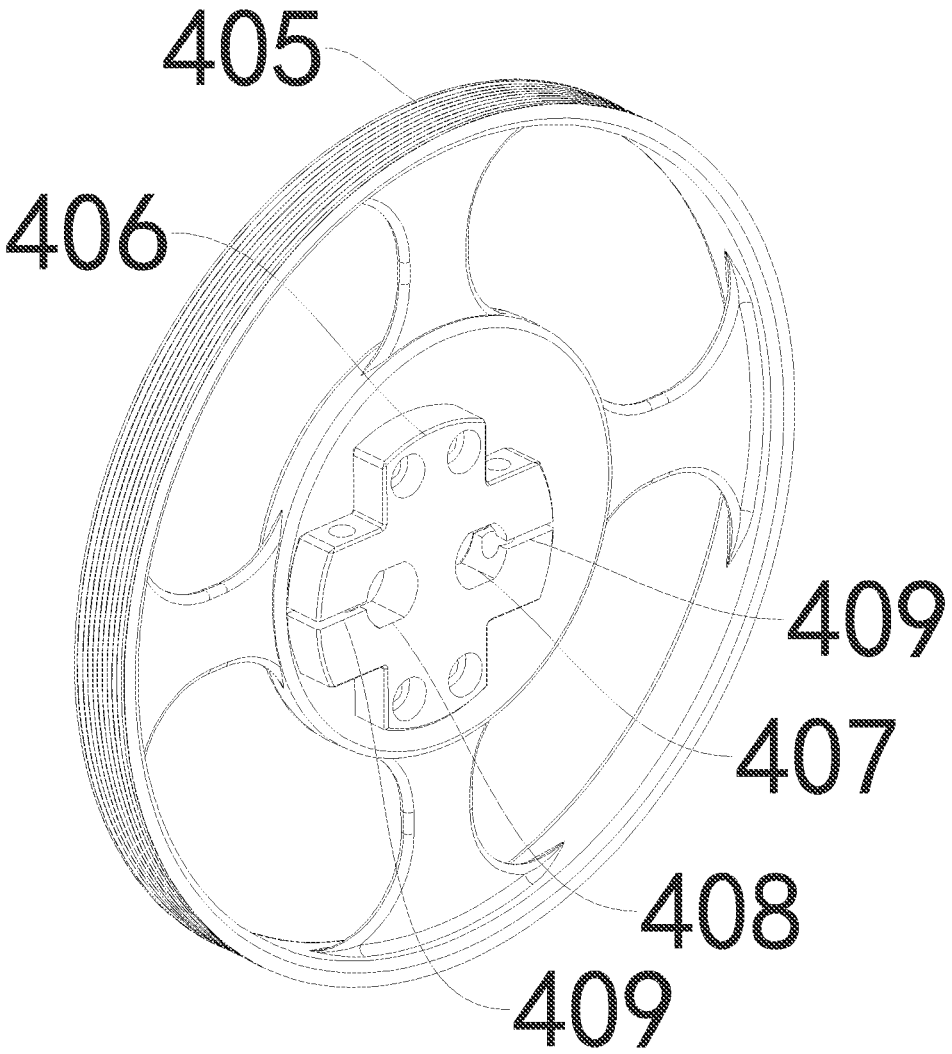
FIG. 15 is a structure schematic diagram of a belt pulley and a right connecting crank according to the present disclosure.

As shown in FIGS. 14-15, open grooves 409 are formed on two sides of each of the central shaft pin holes 407 and the crank pin holes 408 in the left connecting crank 404 and the right connecting crank 406; and a plane perpendicular to the open grooves 409 is further provided with threaded holes configured to install locking bolts. Therefore, it is convenient to install and fix the central shaft 401 and the crank fixing shafts 441 on two sides.

As shown in FIGS. 1-19, swing armrest fixing shafts 113 are welded and fixed to the middles of two sides of the main frame bent pipe 101; the swing armrest assemblies 6 are movably installed on the swing armrest fixing shafts 113; each of the swing armrest assemblies 6 includes an armrest pipe 601, a swing armrest fixing plate 602, a swing armrest rotating shaft fixing seat 603, swing armrest bearings 604 and an L-shaped handle 605; the L-shaped handle 605 is installed at an upper end of the armrest pipe 601; the swing armrest fixing plate 602 is welded to a lower end of the armrest pipe 601; the swing armrest rotating shaft fixing seat 603 is fixedly installed at an upper end of the swing armrest fixing plate 602; the swing armrest bearings 604 are symmetrically installed in the swing armrest rotating shaft fixing seat 603, and are sleeved on the corresponding swing armrest fixing shaft 113; the swing armrest assembly 6 may rotate around the corresponding swing armrest fixing shaft 113; and a pedal pipe 606 is further installed at an end portion of the corresponding swing armrest fixing shaft 113. The user also may put two feet on the pedal pipes, and just use two hands to pull the L-shaped handles back and forth in a dislocated manner, so as to drive the drive assembly only by force of the two hands, and then the drive assembly drives the fan assembly to rotate, so as to better exercise the arms.

Figure 12:
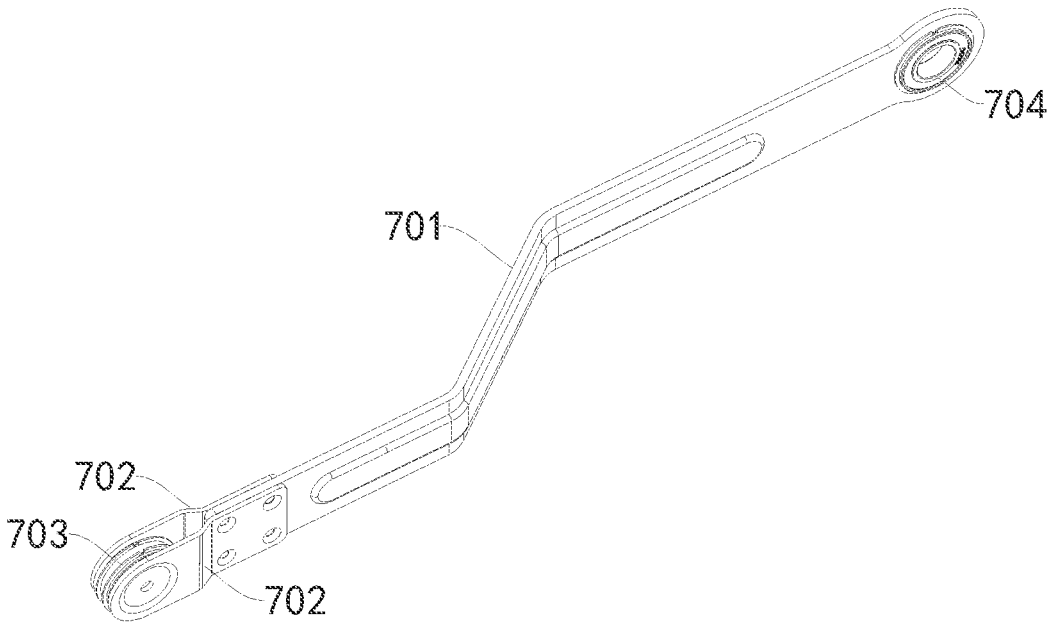
FIG. 12 is a structure schematic diagram of a connecting rod assembly according to the present disclosure.
Figure 13:
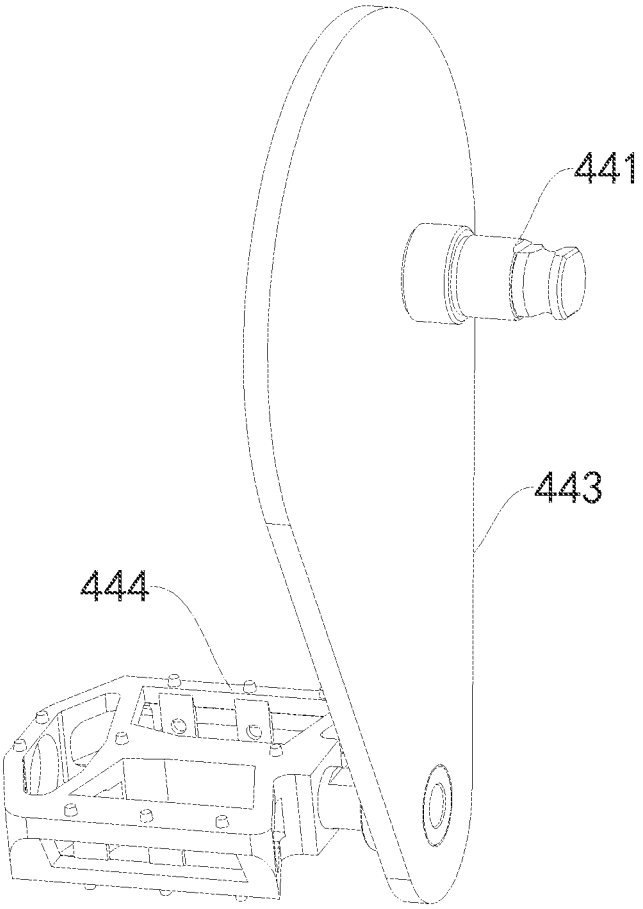
FIG. 13 is a structure schematic diagram of a pedal assembly according to the present disclosure.

As shown in FIG. 12, each of the connecting rod assemblies (7) includes a connecting rod 701, connecting rod fixing pressure plates 702, a front bearing 703 with a snap ring and the rear bearing 704 with the snap ring; the connecting rod fixing pressure plates 702 are symmetrically installed at the end, close to the corresponding swing armrest assembly 6, of the connecting rod 701; the front bearing 703 with the snap ring is installed between the two connecting rod fixing pressure plates 702; the connecting rod fixing pressure plates 702 are rotatably connected with the corresponding swing armrest fixing plate 602 by the front bearing 703 with the snap ring; and a rear end of the connecting rod 701 is rotatably connected with the corresponding crank fixing shaft 441 by the rear bearing 704 with the snap ring.

Figure 16:
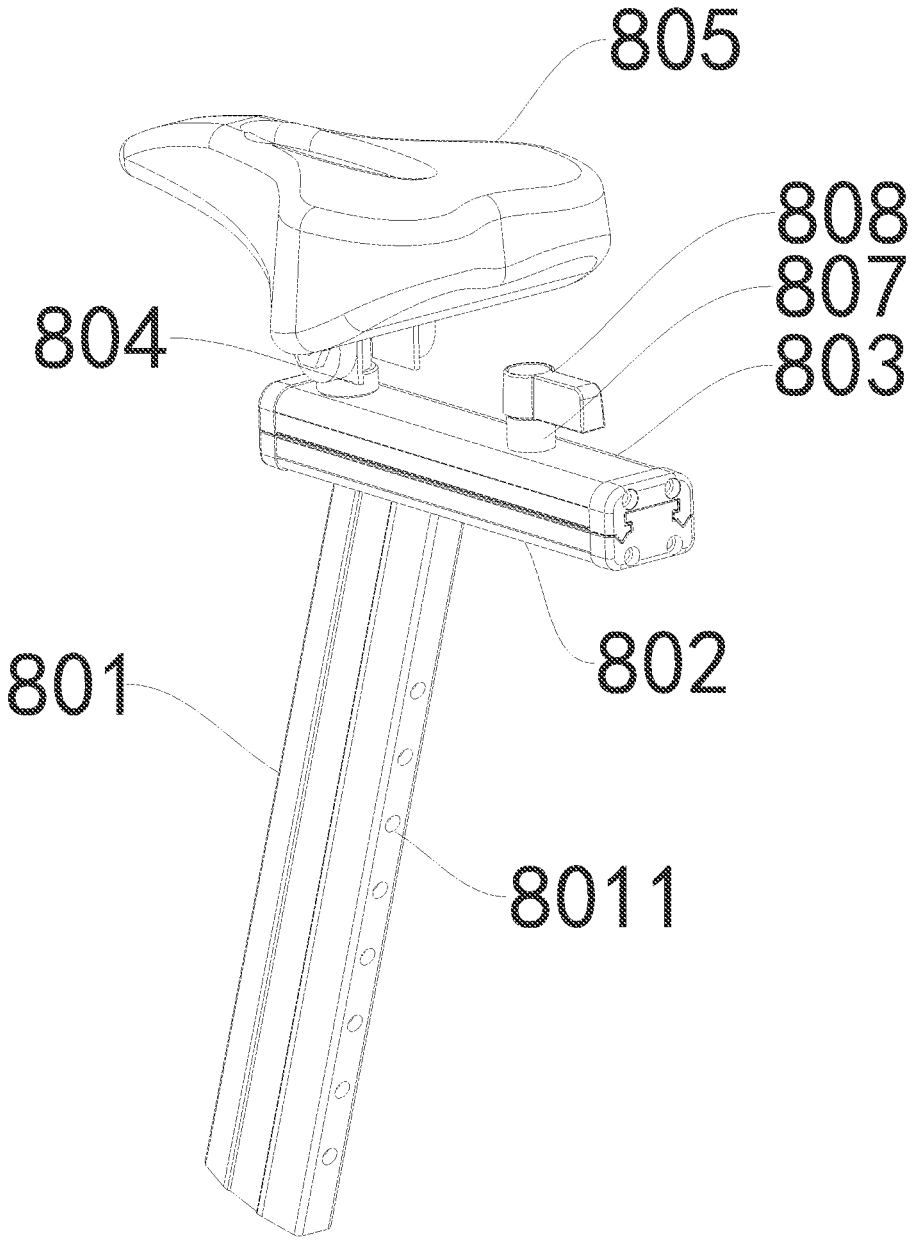
FIG. 16 is a structure schematic diagram of a seat cushion assembly according to the present disclosure.
Figure 17:
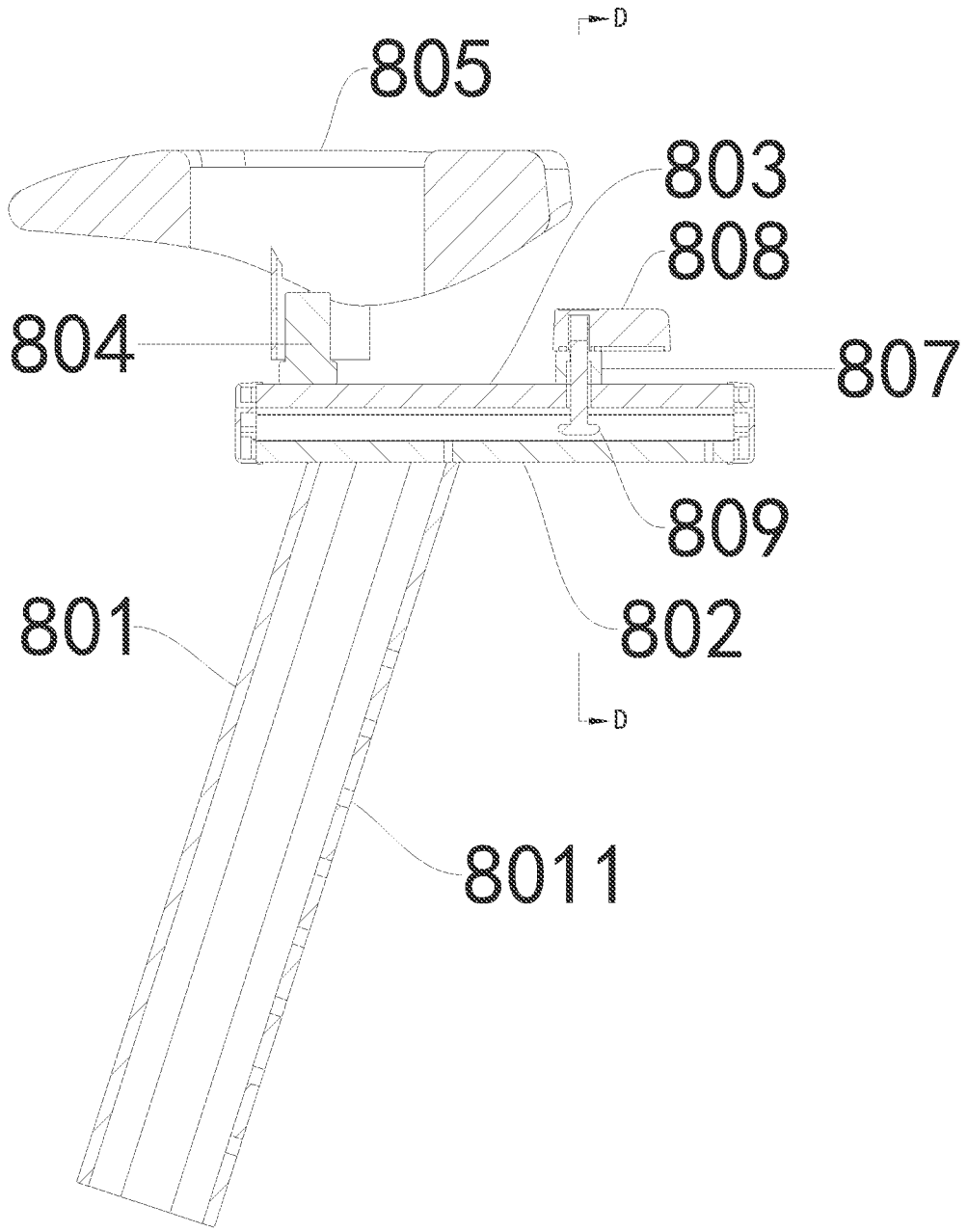
FIG. 17 is a structure schematic diagram of a cross-sectional view of the seat cushion assembly according to the present disclosure.
Figure 18:
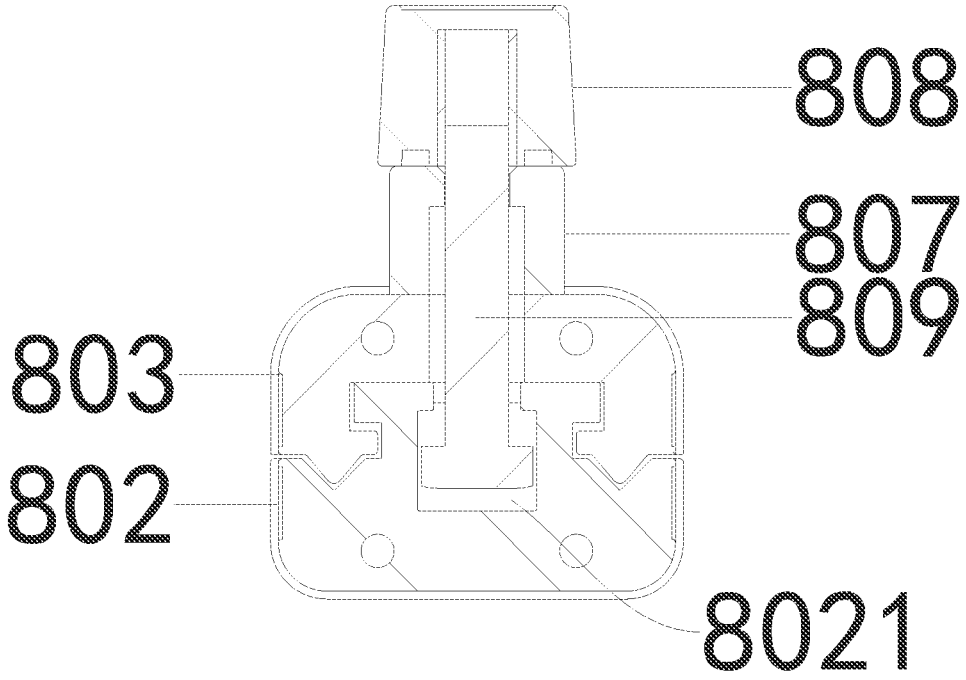
FIG. 18 is a cross-sectional view at D-D in FIG. 17 of the present disclosure.
Figure 19:
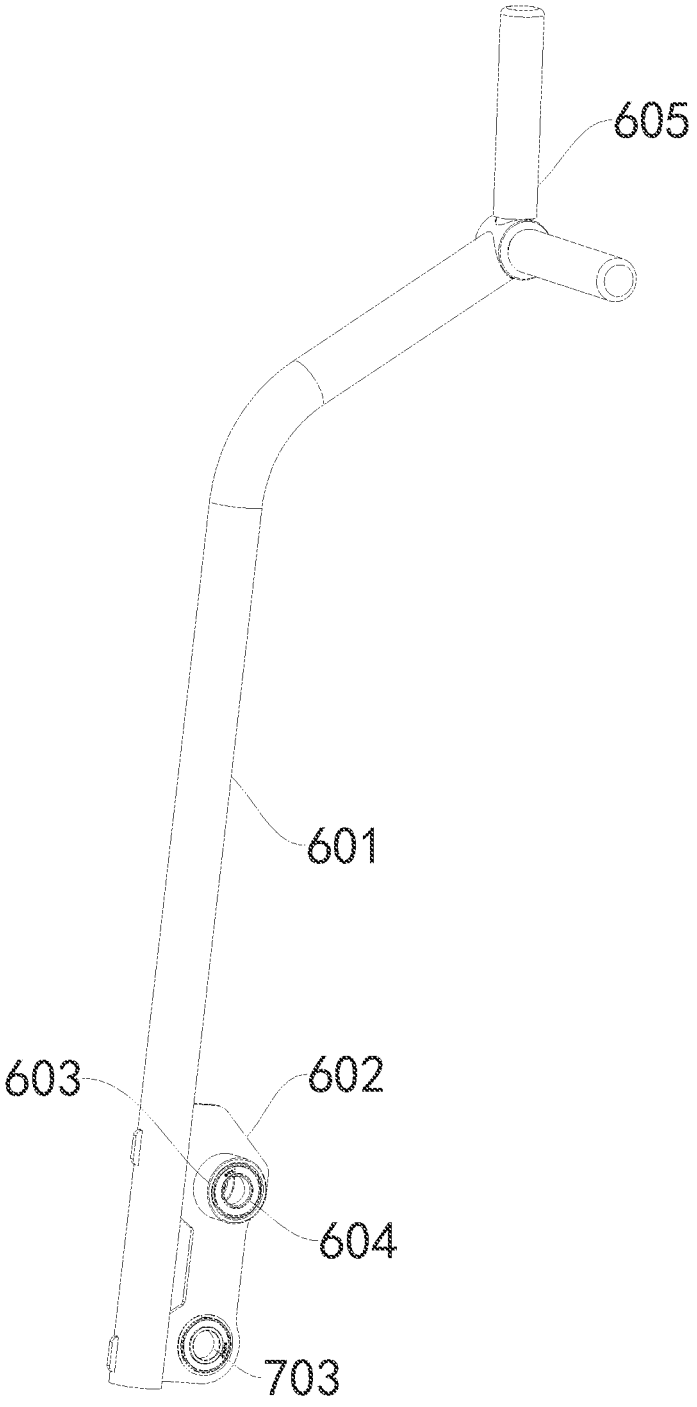
FIG. 19 is a structure schematic diagram of a swing armrest assembly according to the present disclosure.

As shown in FIGS. 16-18, the seat cushion assembly 8 includes a lifting adjustment pipe 801 inserted into the seat cushion support pipe 108, a lower slider 802 welded to the top of the lifting adjustment tube 801, an upper slider 803 movably installed at an upper end of the lower slider 802 and a seat cushion 805 installed on the upper slider 803 by a seat cushion fixing shaft 804; a plurality of insertion holes 8011 are evenly distributed in the lifting adjustment pipe 801; a quick release wrench 806 is further installed at a rear end of the seat cushion support pipe 108; a bolt of the quick release wrench 806 may be inserted into the plurality of insertion holes 8011, so as to adjust the height of the seat cushion 805; the upper slider 803 is further provided with an adjustment assembly; the lower slider 802 is internally provided with a square groove 8021; the adjustment assembly includes a seat cushion limiting sleeve pipe 807, a knob 808 and a limiting bolt 809; the limiting bolt 809 penetrates through the seat cushion limiting sleeve pipe 807 upwards and then is in threaded connection with the knob 808; a lower end of the limiting bolt 809 is disposed in the square groove 8021 and has a shape that matches with the square groove 8021; and the knob 808 may drive the limiting bolt 809 to move up or down. Thus, the seat cushion may be adjusted according to the lengths of the upper half bodies and lower half bodies of people of different heights, so as to achieve a most comfortable exercise position.

As shown in FIGS. 1-4, a front foot pipe 116 is installed at a lower end of the main frame front fixing plate 114; rollers are installed at a front end of the front foot pipe 116; a rear foot pipe 118 is installed at a lower end of the main frame rear fixing plate 115; rubber foot pads 119 are installed at a lower end of each of the front foot pipe 116 and the rear foot pipe 118, so that the spinning bike has better support force, and the safety of operation is improved; meanwhile, the rollers are arranged, so that the spinning bike is convenient to carry and move; an electronic meter connecting pipe 120 is installed at an upper end of the meter panel fixing pipe 109; the electronic meter 121 is installed at an upper end of the electronic meter connecting pipe 120, and is electrically connected with the speed sensor 306; a front fan cover 206 and a rear fan cover 207 are further installed on an outer side of the fan assembly 2; a wind shield 208 is installed at a front end of the main frame pipe 110, so that on one hand, dust may be prevented, and on the other hand, the air flow generated by the fan blades are prevented from directly acting on the human body to prevent a cold; and a water bottle holder 122 is installed at a rear end of the main frame pipe 110, so that a water bottle may be conveniently placed, and people may replenish water in time when doing exercise.

A working principle: first, the user may adjust the height of the seat cushion via the quick release wrench 806 by adjusting the seat cushion assembly 8; the seat cushion may be adjusted back and forth by the adjustment assembly; after the best seat cushion position is obtained, the user holds the L-shaped handles 605 with two hands and steps on the pedals 444 to drive the belt pulley 405 to rotate; and the belt pulley 405 is connected with the fan blade fixing pipe 201 by the multi-groove belt 5, so that the fan assembly 2 may be driven to rotate. Since there are the multiple fan blades 203, greater wind resistance may be provided, the user is provided with enough pedaling resistance, and the fitness effect is improved. Meanwhile, the fan assembly rotates to generate air flow to promote indoor air circulation, thereby enabling people to effectively persist in exercising and preventing heat stroke; the armrests are swung in a dislocated manner by stepping on the pedals, and then people may move their hands by dislocation movement after holding the L-shaped handles, so as to exercise the hands; and the user also may put two feet on the pedal pipes, and just use two hands to pull the L-shaped handles back and forth in a dislocated manner, so as to drive the drive assembly only by force of the two hands, and then the drive assembly drives the fan assembly to rotate, so as to better exercise the arms and the upper body.

In the embodiments of the present application, orientation nouns such as "front", "rear", "left", "right", etc. are only described according to the directions shown in the drawings shown in the present application, and are not limited to the limitation of the protection scope of claims in the present application. In a specific implementation process, the embodiments may be correspondingly varied to obtain other identical or similar embodiments that are all within the protection scope of the present application, and for other similar or identical embodiments, repeated description is not made in the present application.

In the description of the present disclosure, it is to be noted that terms "installed", "connected" and "connection" should be understood in a broad sense, unless otherwise expressly specified and defined; for example, the "connection" may be a fixed connection, a detachable connection, or an integral connection; moreover, the "connection" may be a mechanical connection, or an electrical connection; and the "connected" may be directly connected, indirectly connected by an intermediate medium, or internal communication between two elements. For those of ordinary skill in the art, specific meanings of the above terms in the present disclosure may be understood according to specific circumstances.

Finally, it should be noted that the above content is merely used to illustrate the technical solution of the present disclosure, but not to limit the protection scope of the present disclosure. Simple modifications or equivalent substitutions made by those of ordinary skill in the art to the technical solution of the present disclosure shall not depart from the spirit and scope of the technical solution of the present disclosure.

The invention claimed is:

1. A wind resistance spinning bike, comprising: a frame assembly, wherein a fan assembly is installed at a front end of the frame assembly by a fan fixing assembly; a drive assembly is installed at a rear end of the frame assembly; the drive assembly is connected with the fan assembly by a multi-groove belt; the drive assembly drives the fan assembly to rotate; swing armrest assemblies are installed on two sides of the front end of the frame assembly, and are connected with the drive assembly by connecting rod assemblies; a seat cushion assembly is installed on an upper portion of the rear end of the frame assembly;

the fan assembly comprises a fan blade fixing pipe, two fan blade fixing sheets and a plurality of fan blades; the two fan blade fixing sheets are welded and fixed to the fan blade fixing pipe; the fan blades are fixed and welded to the two fan blade fixing sheets around the circumference; the fan blade fixing pipe is provided with a through hole in the center; two ends of the through hole are provided with fixing pipe bearings; one end of the fan blade fixing pipe is provided with a groove configured to install the multi-groove belt;

the frame assembly comprises a main frame bent pipe; the main frame bent pipe is U-shaped; two rim fixing plates are symmetrically welded to the main frame bent pipe; the rim fixing plates are provided with U-shaped grooves; the fan assembly is installed on the rim fixing plates by the fan fixing assembly; the fan fixing assembly comprises a rim shaft core arranged in the central through hole of the fan blade fixing pipe, rim limiting sleeves symmetrically installed on two sides of the rim shaft core, nuts and flange nuts; two ends of the rim shaft core are provided with external threads; the nuts, the flange nuts and the rim shaft core are in threaded connection; the two ends of the rim shaft core are installed in the U-shaped grooves of the rim fixing plates; and the flange nuts are installed on the rim shaft core on the outer sides of the rim fixing plates;

wherein chain puller assemblies are symmetrically installed on two sides of the rim shaft core; each of the chain puller assemblies comprises a chain puller, a chain puller pressing sheet and a locking nut; one end of the chain puller is provided with a gasket, and the other end of the chain puller is provided with a screw; the gasket is sleeved on the rim shaft core and is arranged between the flange nut and the rim fixing plate; the chain puller pressing sheet and the locking nut are installed at an end portion of the screw; the chain puller pressing sheet abuts against a top surface of the rim fixing plate; and when the locking nut is tightened, the chain puller can pull the fan assembly and the fan fixing assembly to move away from the drive assembly, so as to adjust the tightness of the multi-groove belt; and wherein a sensor fixing plate is welded to a rim limiting sleeve of the rim limiting sleeves on one side of the rim shaft core; a speed sensor is installed on the sensor fixing plate; and a magnet is fixedly installed on a first fan blade fixing sheet of the two fan blade fixing sheets, wherein the speed sensor senses the magnet.

2. The wind resistance spinning bike according to claim 1, wherein the frame assembly further comprises a beveled connecting pipe welded to a lower portion of the main frame bent pipe; the beveled connecting pipe is U-shaped; a bent pipe connecting pipe is welded to a rear end of the beveled connecting pipe; a rear support pipe is welded to a rear end of the bent pipe connecting pipe; a rotating shaft fixing pipe is welded to an upper end of the middle of the bent pipe connecting pipe; a seat cushion support pipe is welded to an upper end of the rotating shaft fixing pipe; the middle of the seat cushion support pipe and an upper end of the rear support pipe are welded and fixed; a meter panel fixing pipe is welded to a top of the main frame bent pipe; a main frame pipe is welded between the meter panel fixing pipe and the bent pipe connecting pipe; a reinforcing pipe is welded between the main frame pipe and the seat cushion support pipe; a rotating shaft fixing seat is installed on the rotating shaft fixing pipe; a main frame front fixing plate is welded to a bottom of the main frame bent pipe;

and a main frame rear fixing plate is welded to a lower end of the rear support pipe.

3. The wind resistance spinning bike according to claim 2, wherein the drive assembly comprises a central shaft, central shaft bearings, a crank limiting sleeve, a left connecting crank, a belt pulley, a right connecting crank and pedal assemblies; the central shaft is installed in the rotating shaft fixing seat; the central shaft bearings are symmetrically installed between the central shaft and the rotating shaft fixing seat; the crank limiting sleeve is installed on a left side of the central shaft; the left connecting crank is installed on a left side of the crank limiting sleeve; the belt pulley is installed on a right side of the central shaft; the right connecting crank is installed on a right side of the belt pulley by bolts; the belt pulley is connected with the fan blade fixing pipe by the multi-groove belt; each of two ends of the central shaft is provided with a central shaft pin; each of the left connecting crank and the right connecting crank is provided with a central shaft pin hole; the central shaft pins are respectively inserted into the central shaft pin holes of the left connecting crank and the right connecting crank; the left connecting crank and the right connecting crank are also provided with crank pin holes; each of the left connecting crank and the right connecting crank is provided with a pedal assembly of the pedal assemblies by the corresponding crank pin hole; each pedal assembly comprises a crank fixing shaft, a crank fixing sleeve, a pedal connecting plate and a pedal; the crank fixing shaft is inserted into the corresponding crank pin hole; the crank fixing sleeve is sleeved on the crank fixing shaft; the pedal connecting plate is fixedly installed on an outer side of the crank fixing shaft; and the pedal is installed on an outer side of the pedal connecting plate.

4. The wind resistance spinning bike according to claim 3, wherein swing armrest fixing shafts are welded and fixed to middles of two sides of the main frame bent pipe; the swing armrest assemblies are movably installed on the swing armrest fixing shafts; each of the swing armrest assemblies comprises an armrest pipe, a swing armrest fixing plate, a swing armrest rotating shaft fixing seat, swing armrest bearings and an L-shaped handle; the L-shaped handle is installed at an upper end of the armrest pipe; the swing armrest fixing plate is welded to a lower end of the armrest pipe; the swing armrest rotating shaft fixing seat is fixedly installed at an upper end of the swing armrest fixing plate; the swing armrest bearings are symmetrically installed in the swing armrest rotating shaft fixing seat, and are sleeved on the corresponding swing armrest fixing shaft; the swing armrest assembly rotates around the corresponding swing armrest fixing shaft; and a pedal pipe is also installed at an end portion of the corresponding swing armrest fixing shaft.

5. The wind resistance spinning bike according to claim 4, wherein each of connecting rod assemblies comprises a connecting rod, connecting rod fixing pressure plates, a front bearing with a snap ring and a rear bearing with a snap ring; the connecting rod fixing pressure plates are symmetrically installed at a front end, close to the corresponding swing armrest assembly, of the connecting rod; the front bearing with the snap ring is installed between the two connecting rod fixing pressure plates; the connecting rod fixing pressure plates are rotatably connected with the corresponding swing armrest fixing plate by the front bearing with the snap ring; and a rear end of the connecting rod is rotatably connected with a corresponding crank fixing shaft by the rear bearing with the snap ring.

6. The wind resistance spinning bike according to claim 5, wherein a front foot pipe is installed at a lower end of the main frame front fixing plate; rollers are installed at a front end of the front foot pipe; a rear foot pipe is installed at a lower end of the main frame rear fixing plate; rubber foot pads are installed at a lower end of each of the front foot pipe and the rear foot pipe; an electronic meter connecting pipe is installed at an upper end of the meter panel fixing pipe; an electronic meter is installed at an upper end of the electronic meter connecting pipe, and is electrically connected with the speed sensor; a front fan cover and a rear fan cover are further installed on an outer side of the fan assembly; a wind shield is installed at a front end of the main frame pipe; and a water bottle holder is installed at a rear end of the main frame pipe.

7. The wind resistance spinning bike according to claim 3, wherein open grooves are formed on two sides of each of the central shaft pin holes and the crank pin holes in the left connecting crank and the right connecting crank; and a plane perpendicular to the open grooves is also provided with threaded holes configured to install locking bolts.

8. The wind resistance spinning bike according to claim 2, wherein the seat cushion assembly comprises a lifting adjustment pipe inserted into the seat cushion support pipe, a lower slider welded to a top of the lifting adjustment pipe, an upper slider movably installed at an upper end of the lower slider and a seat cushion installed on the upper slider by a seat cushion fixing shaft; a plurality of insertion holes are evenly distributed in the lifting adjustment pipe; a quick release wrench is further installed at a rear end of the seat cushion support pipe; a bolt of the quick release wrench is inserted into the plurality of insertion holes, so as to adjust a height of the seat cushion; the upper slider is further provided with an adjustment assembly; the lower slider is internally provided with a square groove; the adjustment assembly comprises a seat cushion limiting sleeve pipe, a knob and a limiting bolt; the limiting bolt penetrates through the seat cushion limiting sleeve pipe upwards and then is in threaded connection with the knob; a lower end of the limiting bolt is disposed in the square groove and has a shape that matches with the square groove; and the knob drives the limiting bolt to move up or down.

* * * * *